US005884519A

United States Patent [19]

Theener

[11] Patent Number: 5,884,519

[45] Date of Patent: Mar. 23, 1999

[54] AUTOMATIC HYDRAULIC PIN UP SYSTEM FOR A PIPE BENDING APPARATUS

[76] Inventor: Ronald E. Theener, HCR #64, Box 290, Duchesne, Utah 84021

[21] Appl. No.: 121,641

[22] Filed: Jul. 23, 1998

[51] Int. Cl.[6] ..... B21D 7/025

[52] U.S. Cl. ..... 72/389.8; 72/383; 72/388; 72/389.1; 72/389.6

[58] Field of Search ..... 72/381, 383, 388, 72/389.1, 389.2, 389.6, 389.8

[56] References Cited

U.S. PATENT DOCUMENTS

| | | | |
|---|---|---|---|
| 2,938,564 | 5/1960 | Rhodes | 153/38 |
| 3,934,450 | 1/1976 | Reed | 72/383 |
| 4,331,018 | 5/1982 | Doyle | 72/389 |
| 5,123,272 | 6/1992 | Heaman | 72/389.8 |
| 5,237,847 | 8/1993 | Owens | 72/213 |
| 5,303,572 | 4/1994 | Knudson | 72/389.3 |
| 5,326,249 | 7/1994 | Weissfloch | 72/389.6 |
| 5,353,622 | 10/1994 | Theener | 72/389.8 |
| 5,598,736 | 2/1997 | Erskine | 72/389.6 |
| 5,600,993 | 2/1997 | Heaman | 72/389.6 |

*Primary Examiner*—David B. Jones
*Attorney, Agent, or Firm*—Henderson & Strum

[57] ABSTRACT

An automatic hydraulic system 10 for the actuation of the bending beds 101, 102 hinge plate 103 and pin up plate 104 of a pipe bending apparatus. The hydraulic system 10 includes a hydraulic control circuit unit 14 that controls the operation of a pin up hydraulic ram unit 11, a bending bed hydraulic ram unit 12, and a hinge plate hydraulic ram unit 13 in response to a pair of adjustable detent main control valves 81, 82 and a sequence valve 66, and adjustable hydraulic relief valve 59.

7 Claims, 4 Drawing Sheets

AUTOMATIC HYDRAULIC PIN UP SYSTEM FOR A PIPE BENDING APPARATUS

CROSS REFERENCE TO RELATED APPLICATIONS

This application is an improvement over U.S. Pat. No. 5,353,622 which issued on Oct. 11, 1994 and is entitled "Articulated Three Point Bending Apparatus", the content of which is incorporated herein by reference.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of pipe bending apparatus in general, and in particular to an automatic hydraulic system to sequentially engage different portions of the pipe that is subjected to the bending process.

2. Description of Related Art

As can be seen by reference to the following U.S. Pat. Nos. 2,938,564; 3,934,450; 4,331,018; and 5,237,847, the prior art is replete with myriad and diverse pipe bending apparatus.

While all of the aforementioned prior art constructions are more than adequate for the basic purpose and function for which they have been specifically designed, they are uniformly deficient with respect to their failure to provide a simple, efficient, and practical automatic hydraulic system that sequentially engages different portions of an elongated length of pipe that is to be subjected to the bending process in a predetermined pressure balanced fashion to accomplish the bending function.

As most individuals who operate pipe bending machines are all too well aware, the uneven application of bending pressure on a length of pipe most often results in the collapse of the pipe walls thereby rendering that particular pipe section useless, which is a waste of materials and causes the pipe bending process to be unnecessarily expensive.

As a consequence of the foregoing situation, there has existed a longstanding need for a new and improved type of automatic hydraulic pin up system for pipe bending machines that is pressure balanced and sequential in operation to insure that an even application of pressure is maintained throughout the pipe bending process, and the provision of such a system is a stated objective of the present invention.

BRIEF SUMMARY OF THE INVENTION

Briefly stated, the automatic hydraulic pin up system for a pipe bending machine that constitutes the basis of the present invention comprises in general, a pin up hydraulic ram unit, a hinge plate hydraulic ram unit, and a bending bed hydraulic ram unit which are all controlled by a hydraulic control circuit unit such that pressure is selectively and sequentially applied to all of the hydraulic ram units in a predetermined pressure balanced sequence to effect the bending of a section of pipe.

As will be explained in greater detail further on in the specification, this automatic hydraulic pin up system is specifically designed to be used in conjunction with the articulated three point pipe bending apparatus that formed the basis of my previously issued U.S. Pat. No. 5,353,622.

Furthermore, the hydraulic control circuit unit includes a pair of adjustable detent main control valves wherein one of the main control valves extends all of the hydraulic ram units until a predetermined pressure is sensed by a sequence valve whereupon the adjustable hydraulic relief valve causes the hinge plate hydraulic ram unit to retract and the other of the main control valves can be actuated to continue the extension of the bending bed hydraulic ram unit to complete the bending of a section or length of pipe.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
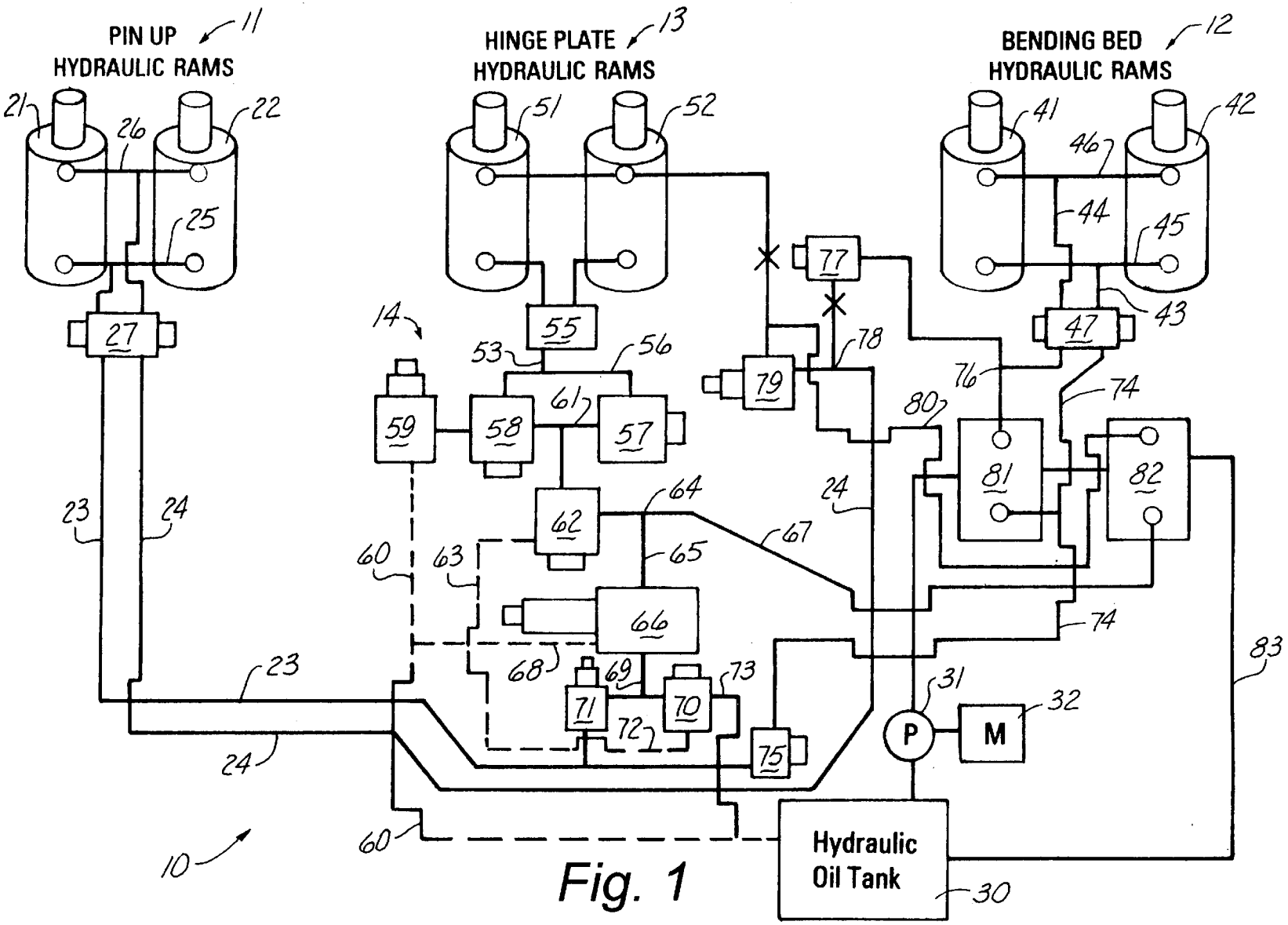
FIG. 1 is a schematic view of the automatic pin up system that forms the basis of the present invention.

As can be seen by reference to the drawings, and in particularly to FIG. 1, the automatic hydraulic system that forms the basis of the present invention is designated generally by the reference number 10. The hydraulic system 10 comprises in general, a pin up hydraulic ram unit 11, a hydraulic ram unit 12, and a bending bed hinge plate hydraulic ram unit 13, all controlled by a hydraulic control circuit unit 14. These units will now be described in seriatim fashion.

Prior to embarking on a detailed description of the hydraulic system 10 that forms the basis of the present invention, it would first be advisable to describe the specific three point pipe bending apparatus 100 that the hydraulic system 10 is specifically designed to be used in cooperation with to effect the bending of a section of pipe 200.

Figure 4:
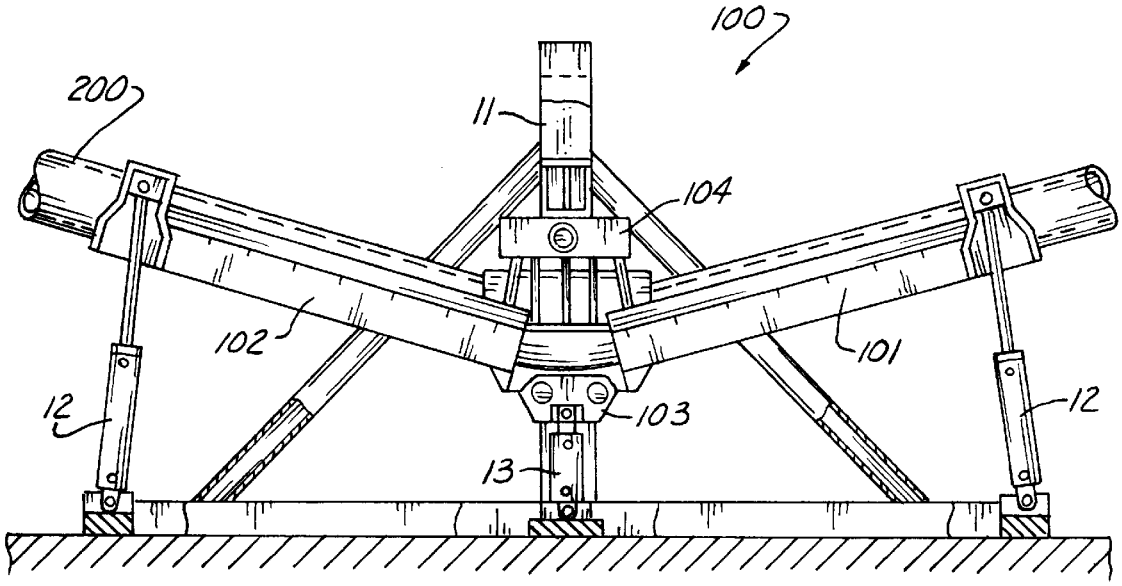
FIG. 4 is a side elevation view of the position of the pipe bending apparatus that conforms to the flow diagram depicted in FIG. 3.
Figure 5:
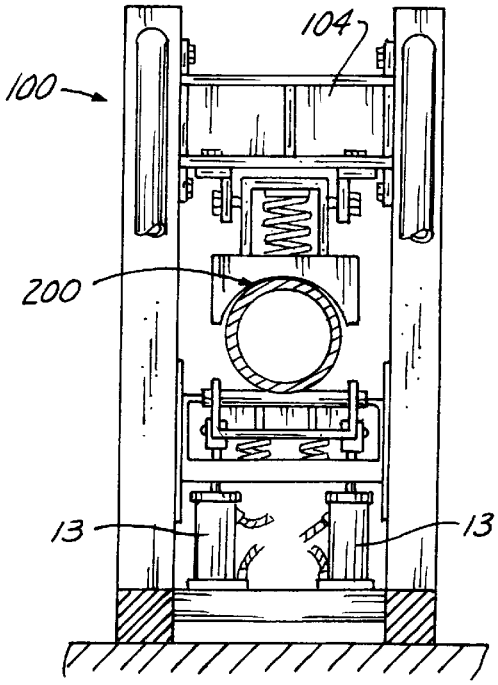
FIG. 5 is a front elevational view of the pipe bending apparatus showing the position of the hinge plate hydraulic ram unit and the pin up hydraulic ram unit and pin up plate which holds the top bending die.

As shown in FIGS. 4 and 5, the articulated three point pipe bending apparatus is designated generally as 100 and includes a pair of elongated bed members 101, 102 whose inboard ends are pivotally connected to a floating hinge plate 103 which cooperates with a pin up plate 104 which holds the top pipe die for captively engaging a section of pipe 200 such that the relative movement between the hinge plate 103, the pin plate 104, and the bed members 101, 102 will produce a selected bend or curvature in the section of pipe 200 at the juncture of the hinge plate 103 and the pin up plate 104.

Still referring to FIGS. 4 and 5, it can be seen that the outboard end of the bed member 101, is operatively associated with the bending bed hydraulic ram unit 12, the hinge plate 103 is operatively associated with the hinge plate hydraulic ram unit 13, and outboard end of bed member 102 is operatively associated with the pin up hydraulic ram unit 11.

Turning now to FIG. 1, it can be seen that the pin up hydraulic ram unit 11 comprises a first pair of hydraulic cylinders 21, 22 operatively connected to one another via a first pair of hydraulic fluid intake and exhaust lines 23, 24 provided with cylinder intake 25 and exhaust 26 conduits. The pin up intake and exhaust lines 23, 24 are further connected to one another by a first double pilot operated check valve 27 wherein the hydraulic fluid that is supplied to the system 10 is provided by a hydraulic reservoir 30 equipped with a pump 31 which is driven by a motor 32.

As can also be seen by reference to FIG. 1, the bending bed hydraulic ram system 12 comprises a second pair of hydraulic cylinders 41, 42 operatively connected to one another by a second pair of hydraulic fluid intake and exhaust lines 43, 44 provided with cylinder intake 45 and exhaust 46 conduits. The bending bed intake and exhaust lines 43, 44 are connected to one another by a second double pilot operated check valve 47.

In addition, the hinge plate hydraulic ram unit 13 comprises a third pair of hydraulic cylinders 51, 52 operatively connected to one another by a third pair of hydraulic fluid intake and exhaust lines 53, 54. The fluid intake line 53 passes through a flow divider valve 55.

At this juncture, the hydraulic control circuit unit 14 will be described beginning with the hinge plate flow divider valve 55. The downstream side of the flow divider valve 55 is provided with a branched intake conduit 56 connected on one end to a simple check valve 57 and on the other end to a pilot to close check valve 58 that is connected in turn to an adjustable hydraulic relief valve 59 that is provided with a return line 60 that communicates with the hydraulic oil reservoir 30.

In addition, another branched conduit 61 connects the simple check valve 57 to the pilot to close check valve 58 on the downstream side wherein the branched conduit 61 is connected to a vent to open check valve 62 provided on one side with a return line 63 and on the other side with a branched conduit 64 having one leg 65 connected to a sequence valve 66 wherein operative connection of the other leg 67 will be explained presently.

Furthermore, the sequence valve 66 is provided with a relief conduit 68 and a branched conduit 69 connected on one side to a pilot to close check valve 70 and connected on the other side to a flow control valve 71. The flow control valve 71 is connected to the hydraulic fluid intake line 23 and the pilot to close check valve 70 is connected by a pair of relief conduits 72, 73 to the main relief conduit 60.

Turning now to the right side of FIG. 1, it can be seen that both the hinge plate hydraulic cylinders 51, 52 and the bending bed hydraulic cylinders 41, 42 are hydraulically interconnected to one another by a pair of main hydraulic control valves 81 and 82. The downstream side of the first main control valve 81 is connected via branched conduit 74 on one end to a simple check valve 75 and on the other end to the second double pilot operated check valve 47.

In addition, the upstream side of the first adjustable detent main control valve 81 is connected to another branched conduit 76 which is connected on one end to the other side of the second double pilot operated check valve 47 and connected on the other end to simple check valve 77. The simple check valve 77 is provided with a branched conduit 78 connected on one end to the fluid exhaust line 24 and connected on the other end to flow control valve 79 which is operatively connected to the hinge plate hydraulic cylinders 51, 52 via conduit 54.

Furthermore, the upstream end of conduit 54 above the flow control valve 79 is provided with a conduit 80 which is connected to the upstream end of the second adjustable detent main control valve 82 wherein the downstream end of the second main control valve 82 is connected to the fluid conduit 67 that is in communication with both the sequence valve 66 and the vent to the open check valve 62.

Having now described the valves and fluid conduit connections which form the hydraulic control circuit unit 14 that controls the pin up hydraulic ram units 11, the bending bed hydraulic ram unit 12, and the hinge plate hydraulic ram unit 13, the operative sequence of the various components will now be described in detail.

Figure 2:
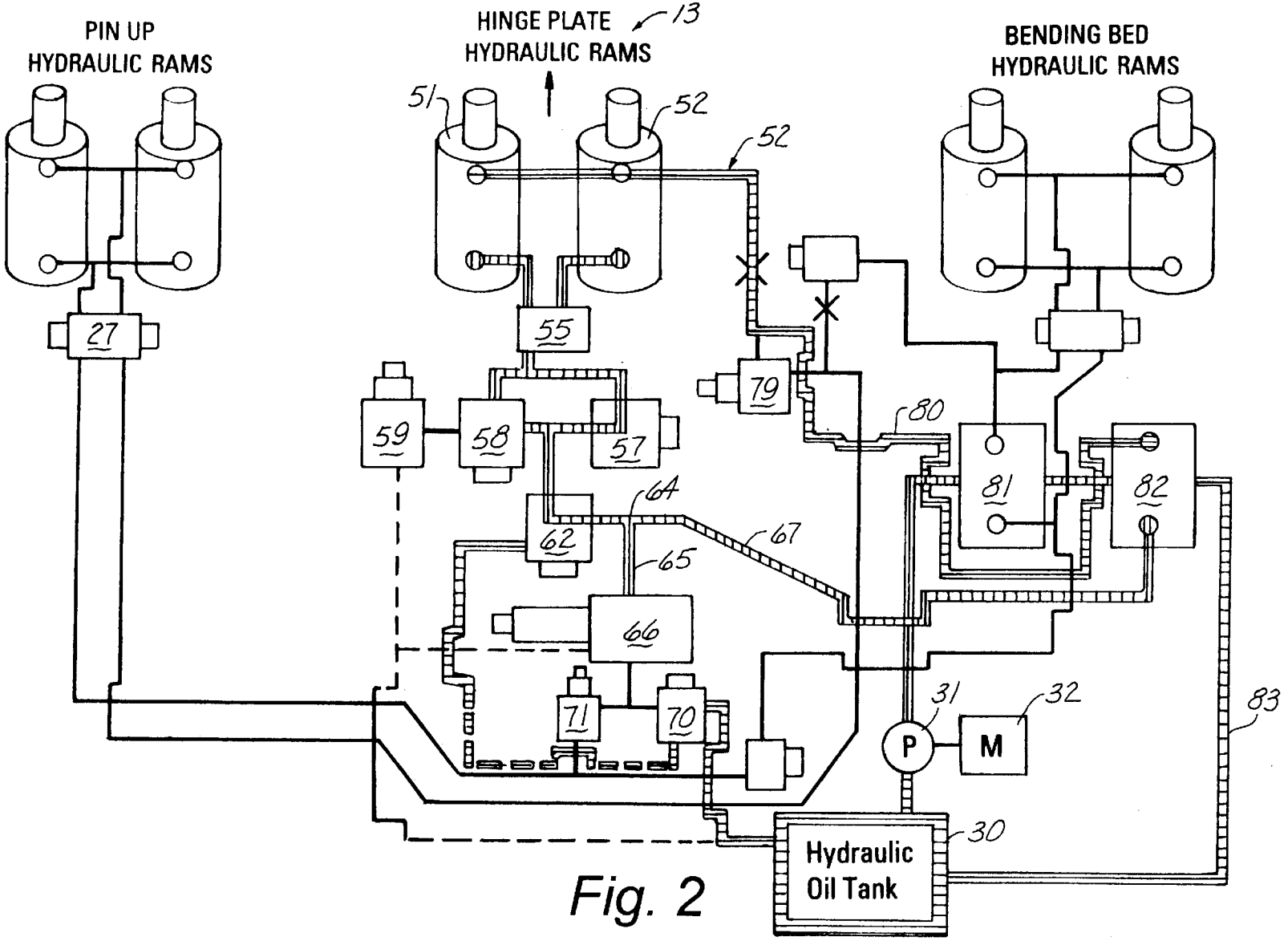
FIG. 2 is a flow diagram depicting the initial engagement of the pin up unit.

Turning now to FIG. 2, it can be seen that in the initial phase of operation of the pipe bending apparatus 100 depicted in FIGS. 4 and 5, the pressure side of the system 10 is lined for the color red and the return side is lined for the color blue.

In the primary stage of the automatic pin up, the high pressure flow is originated from the hydraulic oil tank 30 through the adjustable detent open center main hydraulic control valve 82 through the vent to open check valve 62 and the simple check valve 57 and the hinge plate flow divider valve 55 to the pressure side of the hinge plate hydraulic cylinders 51 and 52 wherein the return flow from the hydraulic cylinders 51, 52 will travel through conduits 54 and 80 to the main hydraulic control valve 82 to raise the hinge plate hydraulic cylinders 51, 52 into engagement with the bottom of the section of pipe 200.

In addition, the vent to open check valve 62 due to its reverse flow installation can vent through the pilot to close valve 70 to the hydraulic oil tank 30.

Figure 3:
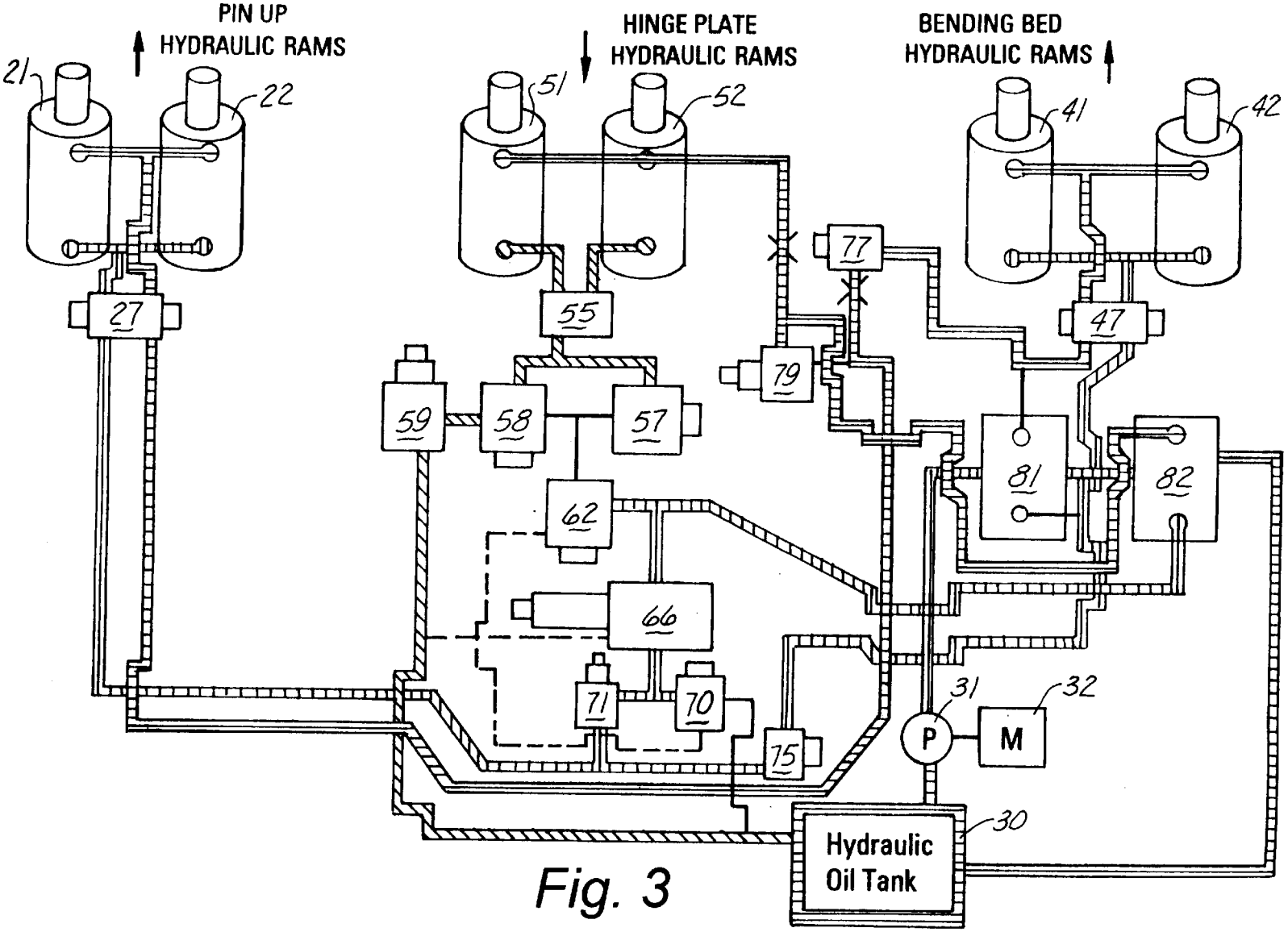
FIG. 3 is a flow diagram depicting the fully loaded hydraulic system in the process of bending the pipe.

Turning now to FIGS. 3 and 4, it can be seen that when the pressure to seat the pipe 200 firmly between the hinge plate hydraulic cylinders 51, 52 and pin up plate 104 which holds the top pipe die it exceeds the pressure setting on sequence valve 66, flow is diverted through flow control valve 71 and simultaneously through simple check valve 75 and first and second double pilot valves 27 and 47 to the pressure side of the pin up hydraulic cylinders 21, 22 and the bending bed hydraulic cylinders 41 and 42.

Simultaneously back pressure from flow control valve 71 sets a consistent pilot pressure to pilot to close check valve 70. This in turn causes vent to open check valve 62 to close, thereby stopping the pilot pressure flow to pilot to close valve 58. This sequence in turn allows return or back pressure from the hinge plate hydraulic cylinders 51, 52 to act on the adjustable hydraulic relief valve 59 and allow the cylinders 51, 52 to descend naturally as the pin up cylinders 21, 22 and the bending bed cylinders 41, 42 continue to extend. Then when the pipe 200 reaches the optimum bending tension as determined by the second adjustable detent main control valve 82 the flow is stopped and the section of pipe is ready to be bent by the actuation of the first adjustable detent main control valve 81 which will continue the extension of the bending bed cylinders 41, 42.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An automatic hydraulic system for use with a three point pipe bending apparatus including a pair of bending beds having inboard and outboard ends wherein the inboard ends are pivotally connected to a hinge plate which cooperates with the pin up plate which holds the top pipe die to captively engage a section of pipe that is to be bent by the pipe bending apparatus; wherein, the automatic hydraulic system comprises:

a pin up hydraulic ram unit operatively associated with said hinge plate;

a bending bed hydraulic ram unit operatively associated with said hinge plate;

a hinge plate hydraulic ram unit including two pair of hydraulic cylinders wherein each one of said pair of hydraulic cylinders are operatively associated with one of the outboard ends of said pair of bending beds; and a hydraulic control circuit unit operatively associated with said pin up hydraulic ram unit, said hinge plate hydraulic ram unit and said bending bed hydraulic ram unit and including a pair of adjustable detent main control valves wherein at least one of said pair of adjustable detent main control valves is in hydraulic communication with all of said hydraulic ram units, and a sequence valve operatively associated with at least one of said pair of adjustable detent main control valves for lowering said hinge plate hydraulic ram unit in response to a predetermined bending pressure being sensed by said sequence valve and adjustable hydraulic relief valve.

2. The hydraulic system as in claim 1 wherein said sequence valve is operatively associated on one side with a vent to open check valve and operatively associated on the other side with a pilot to close check valve and a flow control valve.

3. The hydraulic system as in claim 2 wherein the hinge plate ram unit is operatively associated on one side with a single check valve, a pilot to close valve and a hydraulic relief valve in one mode of operation.

4. The hydraulic system as in claim 3 wherein the hinge plate ram unit is operatively associated on said one side with the simple check valve, the pilot to close valve and the vent to open check valve in another mode of operation.

5. The hydraulic system as in claim 4 wherein said pin up hydraulic ram unit comprises a second pair of hydraulic cylinders and the bending bed hydraulic ram unit comprises a third pair of hydraulic cylinders.

6. The hydraulic system as in claim 5 wherein said second and third pairs of hydraulic cylinders are each provided with double pilot operated check valves.

7. The hydraulic system as in claim 6 wherein the other of the adjustable detent main control valves is operatively associated with said bending bed and said pin up plate hydraulic ram units to continue the extension of the bending bed and pin up plate units as the hinge plate hydraulic ram unit is retracted in response to the action of said sequence valve and adjustable hydraulic relief.

* * * * *